US008251134B2

(12) United States Patent
Janezich

(10) Patent No.: US 8,251,134 B2
(45) Date of Patent: Aug. 28, 2012

(54) REMOVABLE TUBE HEAT EXCHANGER WITH RETAINING ASSEMBLY

(75) Inventor: Robert Janezich, Hibbing, MN (US)

(73) Assignee: L & M Radiator, Inc., Hibbing, MN (US)

( * ) Notice: Subject to any disclaimer, the term of this patent is extended or adjusted under 35 U.S.C. 154(b) by 896 days.

(21) Appl. No.: 12/272,880

(22) Filed: Nov. 18, 2008

(65) Prior Publication Data

US 2009/0120625 A1 May 14, 2009

Related U.S. Application Data

(63) Continuation of application No. PCT/US2007/069240, filed on May 18, 2007.

(60) Provisional application No. 60/747,700, filed on May 19, 2006.

(51) Int. Cl.
*F28F 9/02* (2006.01)
*F28F 9/04* (2006.01)

(52) U.S. Cl. ..... 165/173; 165/158

(58) Field of Classification Search ..... 165/173, 165/178, 158, 76; 285/19, 20
See application file for complete search history.

(56) References Cited

U.S. PATENT DOCUMENTS

| | | | | |
|---|---|---|---|---|
| 911,156 | A * | 2/1909 | Politz | 277/606 |
| 1,886,645 | A * | 11/1932 | Clarkson | 165/82 |
| 2,969,956 | A * | 1/1961 | Forgo | 165/175 |
| 3,391,732 | A | 7/1968 | Murray | |
| 4,164,255 | A * | 8/1979 | Binet et al. | 165/82 |
| 4,216,824 | A | 8/1980 | Braun et al. | |
| 4,344,478 | A | 8/1982 | Petaja et al. | |
| 4,570,704 | A | 2/1986 | Braun et al. | |
| 4,930,568 | A | 6/1990 | Janezich et al. | |
| 5,236,045 | A | 8/1993 | Janezich et al. | |
| 5,433,268 | A | 7/1995 | Janezich et al. | |
| 5,526,876 | A * | 6/1996 | Karube | 165/176 |
| 6,357,513 | B1 | 3/2002 | Janezich et al. | |

(Continued)

FOREIGN PATENT DOCUMENTS

DE 949 107 C 9/1956

(Continued)

OTHER PUBLICATIONS

Examination Report relating to corresponding CA Application No. 2,652,700.

(Continued)

*Primary Examiner* — Tho V Duong
(74) *Attorney, Agent, or Firm* — Banner & Witcoff, Ltd.

(57) ABSTRACT

A header plate assembly for a heat exchanger includes a plate having a tube side and a tank side. A plurality of apertures extends through the plate. Each aperture has a first portion on the tube side of the plate, the first portion having a first cross-dimension, and a second portion adjacent the first portion and having a second cross-dimension that is smaller than the first cross-dimension, with a first shoulder being formed between the first and second portions. Each of a plurality of collars has an aperture extending therethrough, with a portion of each collar being received in the first portion of one of the apertures in the plate. A seal is positioned in each of the first portions of the apertures and between one of the collars and one of the first shoulders. A plurality of fasteners secures the collars to the plate.

20 Claims, 9 Drawing Sheets

U.S. PATENT DOCUMENTS

| | | | | |
|---|---|---|---|---|
| 6,964,297 | B1 * | 11/2005 | Janezich et al. | 165/178 |
| 2005/0098307 | A1 * | 5/2005 | Goto | 165/146 |

FOREIGN PATENT DOCUMENTS

| | | | | |
|---|---|---|---|---|
| DE | 35 02 116 | A1 | | 3/2009 |
| FR | 2587468 | A | * | 3/1987 |
| GB | 248 890 | A | | 3/1926 |
| GB | 1 465 732 | A | | 3/1977 |
| GB | 2 136 945 | A | | 9/1984 |
| JP | 61-134596 | A | | 6/1986 |

OTHER PUBLICATIONS

English abstract of JP 61-134596.

Office Action dated Jun. 4, 2009 relating to corresponding EP 07762245.4 application filed Nov. 19, 2008.

Response to Office Action dated Oct. 1, 2009 relating to corresponding EP 07762245.4 application filed Nov. 19, 2008.

PCT/US2007/069240 International Search Report and Written Opinion.

Office Action relating to corresponding MX Application No. MX/A/2008/014773.

Redacted English Translation of corresponding MX Application No. MX/A/2008/014773.

Examination Report relating to corresponding EP application No. 07762245.4.

Redacted English Translation of Office Action relating to corresponding MX Application No. MX/A/2008/014773, issued May 9, 2012.

* cited by examiner

POSSIBLE
PRESSURE SEAL
CROSS SECTIONS

POSSIBLE
DUST SEAL
CROSS SECTIONS

REMOVABLE TUBE HEAT EXCHANGER WITH RETAINING ASSEMBLY

RELATED APPLICATIONS

This application is a continuation of PCT application no. PCT/US2007/069240, designating the United States and filed May 18, 2007; which claims the benefit of the filing date of U.S. Provisional Application Ser. No. 60/747,700, filed May 19, 2006; each of which is hereby incorporated herein by reference in its entirety for all purposes.

FIELD OF THE INVENTION

The present invention is directed to a removable tube heat exchanger and header plate, and, more particularly, to an improved heat exchanger header plate with a retaining assembly for removable tube heat exchangers.

BACKGROUND OF THE INVENTION

Heat exchangers typically are formed of a plurality of tube and fin assemblies, the ends of which extend through apertures in opposed header plates. A heating or cooling fluid, e.g., oil, air, etc. flows through the tubes. The tube and fin assemblies must be able to withstand system operating pressures without leaking. Elastomeric seals are sometimes used within the apertures in the header plates to seal the tube within the header plate thus forming a tube to header plate joint. Some heat exchanger designs allow the tube and fin assemblies to be removable such that a damaged tube can be replaced without dismantling an entire heat exchanger. According to prior art heat exchangers, the tubes are removed by raising a first end of a tube into the first of two header plates via a first aperture having a cylindrical seal along the entire length of the header plate opening until the second end of the tube clears the second of two header plates. The second end of the tube is swung outwardly to clear the edge of the second header plate and the tube, which is now angled relative to the first header plate, is then pulled from the first header plate, freeing it from the heat exchanger. Prior art aperture and seal designs allow an elastomeric seal to seat within the first header plate in order to seal the tube during heat exchanger operation, and also allow angular movement of a tube for removal and installation from the header plates. See, U.S. Pat. Nos. 3,391,732; 4,344,478; 4,216,824; 4,930,568; and 5,433,268, each of which is hereby incorporated by reference in their entireties.

However, prior art aperture and seal designs do not optimize the ability of the heat exchangers to withstand high operating pressures and temperatures while also allowing easy removal and installation of individual heat exchanger tubes. Accordingly, it would be desirable to provide a seal retaining assembly to improve the ability of a heat exchanger to withstand high operating pressures and temperatures while also allowing easy removal and installation of individual heat exchanger tubes. It would also be desirable to provide a heat exchanger header plate which reduces or wholly overcomes some or all of the difficulties inherent in prior known heat exchangers having field removable heat exchanger tubes such as pressure capabilities, temperature capabilities, seal integrity, and overall heat exchanger life expectancy.

Particular objects and advantages of the invention will be apparent to those skilled in the art, that is, those who are knowledgeable or experienced in this field of technology, in view of the following disclosure of the invention and detailed description of certain preferred embodiments.

SUMMARY

Aspects of the present invention may be used to advantageously provide a heat exchanger having advantageous pressure capabilities while facilitating the removal and installation of individual heat exchange tubes without disassembling the frame of the heat exchanger.

In accordance with a first aspect, a header plate assembly for a heat exchanger includes a plate having a tube side and a tank side. A plurality of apertures extends through the plate. Each aperture has a first portion on the tube side of the plate, the first portion having a first cross-dimension, and a second portion adjacent the first portion and having a second cross-dimension that is smaller than the first cross-dimension, with a first shoulder being formed between the first and second portions. Each of a plurality of collars has an aperture extending therethrough, with a portion of each collar being received in the first portion of one of the apertures in the plate. A seal is positioned in each of the first portions of the apertures and between one of the collars and one of the first shoulders. A plurality of fasteners secures the collars to the plate.

In accordance with another aspect, a heat exchanger includes a first header plate having a tube side and a tank side. A plurality of first apertures extends through the first header plate, with each first aperture having a first portion on the tube side of the first header plate, the first portion having a first cross-dimension, a second portion adjacent the first portion and having a second cross-dimension that is smaller than the first cross-dimension, and a first shoulder formed between the first and second portions. Each of a plurality of flow tubes has a first end and a second end and a plurality of fins on an exterior surface thereof. A first end of one of the flow tubes is received in each of the first apertures. Each of a plurality of collars has an aperture extending therethrough, with a portion of the collar being received in the first portion of one of the first apertures in the first header plate. A seal is positioned in each of the first portions of the first apertures in the first header plate, and surrounds one of the flow tubes and is captured between one of the collars and one of the first shoulders. A plurality of fasteners secures the collars to the first header plate.

From the foregoing disclosure, it will be readily apparent to those skilled in the art, that is, those who are knowledgeable or experienced in this area of technology, that the present invention provides a significant technological advance. Preferred embodiments of the heat exchanger header plate of the present invention can provide improved sealing and higher operating pressures while allowing heat exchanger tubes mounted therein to be individually removable, for example without dismantling the heat exchanger. These and additional features and advantages of the invention disclosed here will be further understood from the following detailed disclosure of certain preferred embodiments.

Figure 1:
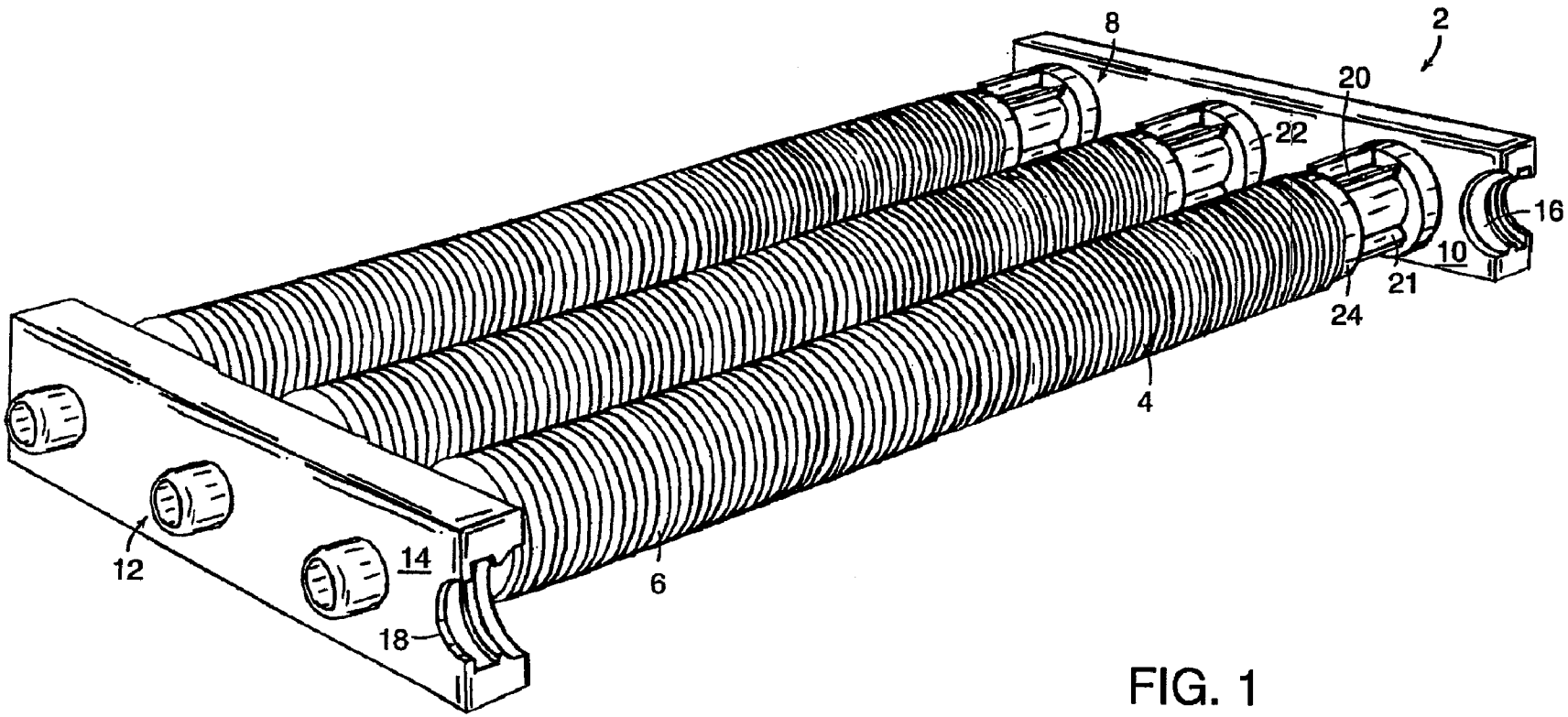
FIG. 1 is a schematic perspective view, shown partially broken away, of tube and fin assemblies of a heat exchanger mounted in opposed header plates.

The figures referred to above are not drawn necessarily to scale and should be understood to provide a representation of the invention, illustrative of the principles involved. Some features of the heat exchanger depicted in the drawings have been enlarged or distorted relative to others to facilitate explanation and understanding. The same reference numbers are used in the drawings for similar or identical components and features shown in various alternative embodiments. Heat exchangers as disclosed herein would have configurations and components determined, in part, by the intended application and environment in which they are used.

DETAILED DESCRIPTION OF CERTAIN PREFERRED EMBODIMENTS

Referring to FIG. 1, a heat exchanger according to the present invention is shown partially cut away as it would be used to cool hot fluid, e.g., oil or air, generated in the use of industrial machinery, e.g., a hydraulic transmission, compressor, or turbocharger (not shown), and is referred to generally by the reference numeral 2. In a typical application, hot fluid would flow through the inside of the flow tubes, while a cooling fluid such as air or other suitable cooling fluid would contact the outside fin section of the flow tube. It is to be understood, however, that the heat exchanger is not limited to use in cooling hot fluid in industrial machinery, and may easily be used with fluids or gases in other fields. For example, embodiments of the present invention find application in heat exchangers such as radiators used to cool an engine where coolant, such as water or antifreeze, flows through the flow tubes and fluid such as air or a suitable liquid can be used to flow around the exterior of the flow tubes. For convenience, the terms "upper" and "lower" are used herein to differentiate between the upper and lower ends of the heat exchanger and particular elements. It is to be appreciated that "upper" and "lower" are used only for ease of description and understanding and that they are not intended to limit the possible spatial orientations of the heat exchanger or its components during assembly or use.

Heat exchanger 2 comprises a plurality of flow tubes 4 having a plurality of fin elements or fins 6 secured to an exterior surface thereof. Tubes 4 are mounted at a first or upper end 8 to a first or upper header plate 10 and at a second or lower end 12 to a second or lower header plate 14. Upper and lower header plates 10, 14 are fixed with respect to one another by a frame of heat exchanger 2 (not shown). Examples of tube and fin element designs useful in the present invention are shown in U.S. Pat. Nos. 4,570,704; 4,344,478; 4,216,824; 3,391,732; 5,433,268; and 5,236,045 each of which are hereby incorporated by reference in its entirety for all purposes.

Heat exchangers within the scope of the present invention include those having a plurality of heat exchanger tubes arranged in columns and rows, and interconnected to receive and pass a heating/cooling fluid (dependent upon application).

The rows extend longitudinally across the heat exchanger, substantially perpendicular to the direction of air or other external fluid flow, and the columns are substantially perpendicular to the rows. The columns, for example, may be "in-line" or "offset" as shown below (top view of tube-and-fin assemblies):

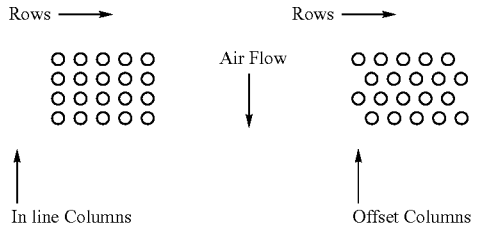

It is to be understood that alternate offset designs are within the scope of the present invention such as where tube-and-fin assemblies of every fourth row are aligned.

Figure 2:
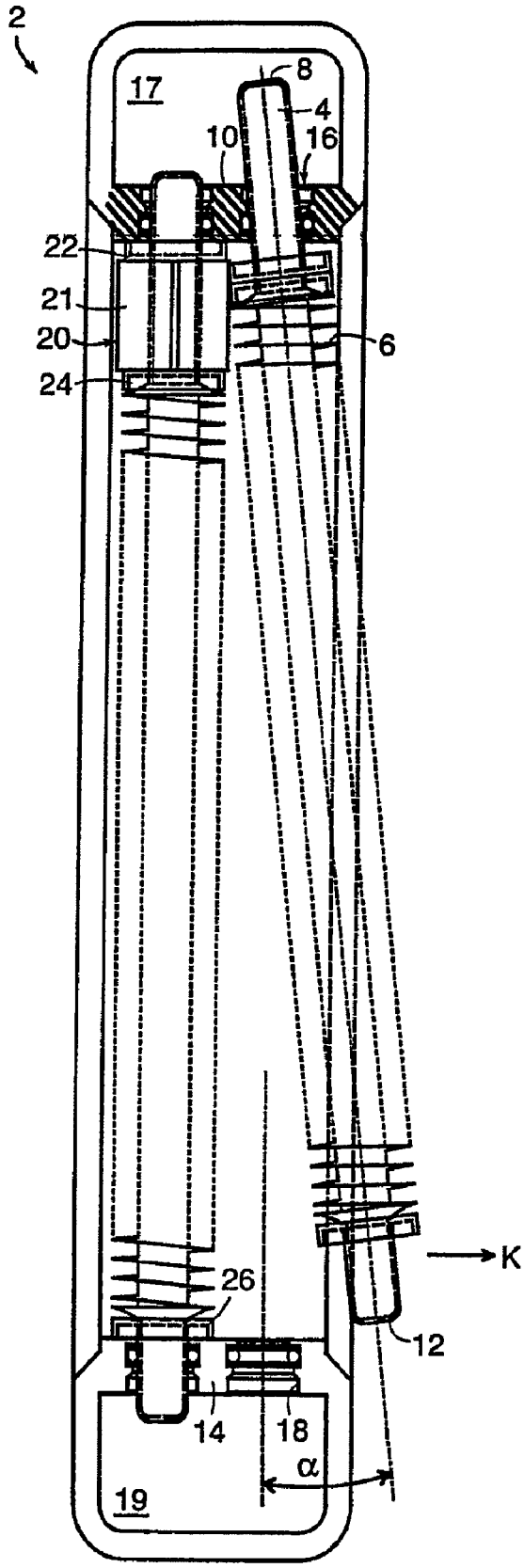
FIG. 2 is a schematic elevation view, shown partially in section, of a tube and fin assembly being removed from the heat exchanger of FIG. 1.

In a preferred embodiment, several rows of tubes 4 extend between upper and lower header plates 10, 14 forming columns. An upper end 8 of each tube 4 extends into an aperture 16 in upper header plate 10 and a lower end 12 extends into aperture 18 in lower header plate 14. Liquid flows from a first or upper tank 17 (seen in FIG. 2) above upper header plate 10 through tubes 4 into second or lower tank 19 (seen in FIG. 2) below lower header plate 14 where it then flows back to the machinery which generates the heated oil.

As shown in FIG. 1 and according to one embodiment of the present invention, a tube retainer 20 is mounted on first end 8 of each tube 4 proximate upper header plate 10. It is to be understood that tube retainer 20 is not be required for all applications of the present invention, especially those applications where a tube retainer is not necessary or desired, and accordingly certain embodiments of the present invention do not include a tube retainer. To the extent a tube retainer is desired, one embodiment of a tube retainer is shown as a substantially C-shaped arcuate body and a plurality of planar, rectangular protruding portions 21 extending radially from the periphery of the arcuate body. Tube retainer 20 serves to hold tube 4 firmly in place within upper header plate 10 and also serves to deflect air toward fins 6. Further description of this one embodiment of a tube retainer 20 is found in U.S. Pat. No. 4,344,478, the contents of which are incorporated herein by reference. It is to be understood that alternate embodiments of the tube retainer useful in the present invention will become apparent to those skilled in the art based upon the disclosure herein. Examples of tube stays or alignment mechanisms if desired in the practice of the present invention are disclosed in U.S. Pat. Nos. 4,216,824; 4,570,704; and 6,357,513, each of which is hereby incorporated by reference in its entirety.

As seen in FIG. 1, a first cap washer 22 is positioned between and abuts upper header plate 10 and tube retainer 20. A second cap washer 24 is positioned between and abuts tube retainer 20 and uppermost fin 6 or a shoulder on tube 4 (not shown). A third cap washer 26 is positioned between and abuts lower header plate 14 and a lowermost fin 6 or shoulder on tube 4 (not shown). As with the tube retainer described above, it is to be understood that the cap washers shown in FIG. 1 are not required for all applications of the present invention, especially those applications where a cap washer is not necessary or desired, and accordingly certain embodiments of the present invention do not include cap washers. In addition, the use of cap washers is by way of example only, and other configurations of washers or components performing the function of washers will become apparent to those of ordinary skill in the art based upon the present disclosure.

Some heat exchangers are designed so as to allow tubes 4 to be removable without the need for disassembling the frame of heat exchanger 2. This can allow quick replacement of damaged or worn tubes while minimizing the associated costs. To remove a tube 4 from heat exchanger 2, as seen in the embodiment illustrated in FIG. 2, tube retainer 20 is removed from tube 4. Upper end 8 of tube 4 is then pushed upwardly through aperture 16 of upper header plate 10 until lower end 12 is above lower header plate 14. Lower end 12 is then swung outwardly at an angle of $\alpha$ in the direction of arrow K or other suitable direction until it is free of lower header plate 14 and heat exchanger 2. Tube 4 is then removed from heat exchanger 2 by pulling downwardly on tube 4 until upper end 8 is free of upper header plate 10. A new tube 4 can then be inserted by reversing the steps outlined above.

The upper and lower ends 8, 12 of tube 4 are exposed to system fluid at operating pressure in upper and lower tanks 17, 19, formed in part by the upper and lower header plates respectively, and, therefore, the high pressure side of the heat exchanger is that area above upper header plate 10 and below lower header plate 14. Correspondingly, the portion of tube and fin assembly 2 between the header plates that is exposed to air is considered the low pressure side. As used herein, the term "tube side" refers to the low pressure side of upper and lower header plates 10, 14, respectively, that is, the area of the upper and lower header plates typically exposed to the air and not exposed directly to the high pressure fluid in the upper and lower tanks 17, 19. Accordingly, the term "tank side" refers to the high pressure side of upper and lower header plates 10, 14, that is, the area of the upper and lower header plates 10 and 14 exposed to the high pressure fluid in the upper and lower tanks 17, 19.

Figure 3:
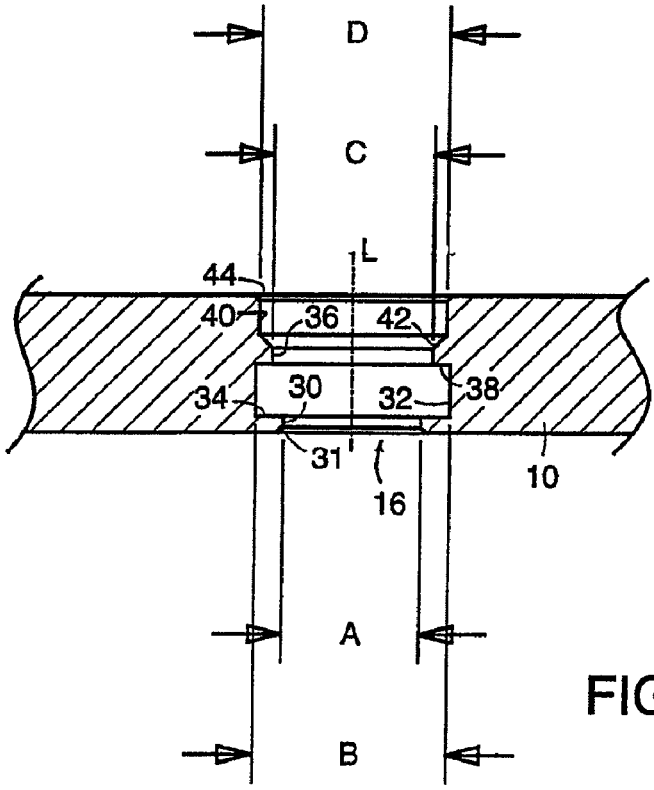
FIG. 3 is a schematic section view of an aperture in the header plate of FIG. 1.

The construction of aperture 16 is shown in more detail in FIG. 3. Aperture 16 has longitudinal axis L. The diameter of aperture 16 is non-uniform along longitudinal axis L, that is, it is non-uniform throughout upper header plate 10. Instead, as shown in FIG. 3, the aperture 16 has at least two different portions and preferably, has four different portions along its length, each having a diameter which may be the same or different from an adjacent portion. The tube side, or first portion 30 has a first diameter A. In certain embodiments such as that shown in FIG. 3, the tube side edge 31 of first portion 30 is beveled or, alternatively, rounded at an angle. It is to be understood that the beveling of certain portions of the aperture wall, such as those portions shown in FIG. 3, is not be required for all applications of the present invention, especially those applications where beveling is not necessary or desired, and accordingly certain embodiments of the present invention do not include the beveling at the one or more location shown in FIG. 3. According to those certain embodiments, the locations where beveling is indicated in FIG. 3 would instead be squared edges. The next portion adjacent first portion 30 is second portion 32, and has a second diameter B which is larger than diameter A. A shoulder 34 is formed between first and second portions 30, 32. Third portion 36 is adjacent second portion 32 and has a diameter C which is smaller than diameter B and typically larger than diameter A. A shoulder 38 is formed between second and third portions 32, 36. The fourth portion 40 which is immediately tank side is adjacent third portion 36 and has a diameter D which is larger than diameter C. As shown in FIG. 3, edge 42 of fourth portion 40 is beveled or, alternatively, rounded as is edge 44 of fourth portion 40.

Figure 4:
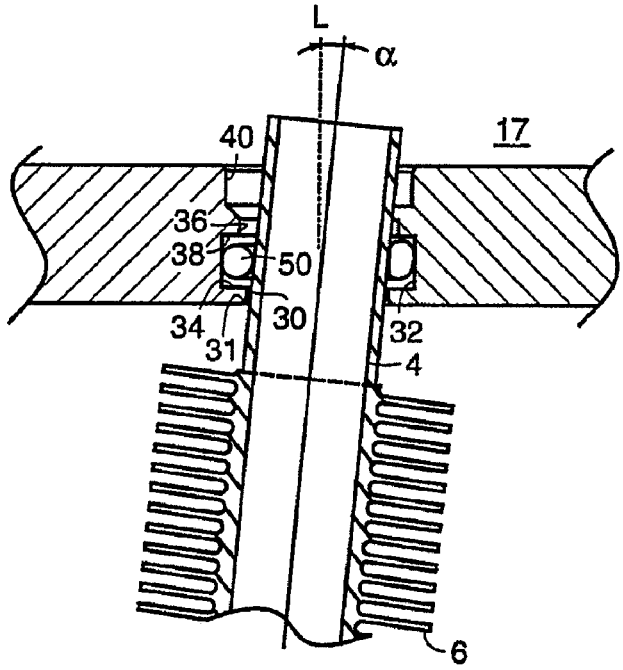
FIG. 4 is a schematic section view of a tube and-fin-assembly being removed the header plate of FIG. 1.
Figure 6:
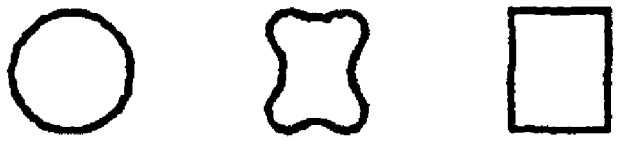
FIG. 6 is a cross-sectional view of alternate seal designs.
Figure 6:
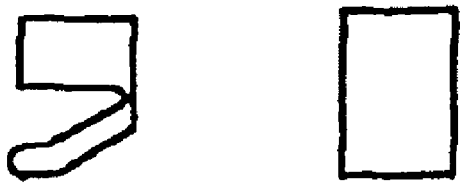

Turning now to FIG. 4, the interaction of tube 4 with aperture 16 during removal and installation of tube 4 can be seen more clearly. A seal 50 surrounds tube 4 and is contained within second portion 32. Seals according to the present invention include those having differing sizes and shapes. For example, seals having a circular cross-section are useful within the scope of the present invention, such as those seals commonly known as "O-rings." Other useful seals include those having a square or rectangular cross-section or a cross-section resembling that of an "X," as shown in FIG. 6. Other suitable seal shapes will become apparent to those skilled in the art based upon the disclosure presented herein and the configuration of the particular aperture, flow tube and chamber within which the seal is seated. The seals may be fashioned from any suitable elastomeric material capable of withstanding operating pressures and temperatures of a given heat exchanger. Useful seals are also resistant to degradation by fluids used in a given heat exchangers. The seals according to the present invention may be installed into the aperture by hand or by suitable instrument so as to seat the seal into a given location in the aperture.

In use, seal 50 is compressed a predetermined amount to provide a proper seal between the tube 4 and the header plate aperture. Seal 50 is held in place by shoulders 34 and 38, with shoulders 34 providing support for seal 50 to resist the pressure incurred at the high pressure side of upper header plate 10, and shoulder 38 providing support far seal 50 during the angled installation of tube 4. Aperture 16 is preferably designed to hold seal 50 captive within upper header plate 10 during installation and removal of tube 4. That is, seal 50 is contained entirely within aperture 16 and does not extend above the tank side of the header plate 10 into the upper tank 17 or below the tube side of the header plate 10. Aperture 16 must be able to accommodate tube 4 being positioned at angle $\alpha$ with respect to longitudinal axis L, which is necessary in order for lower end 12 to clear lower header plate 14 or heat exchange frame during installation and removal without dismantling the frame of the heat exchanger.

The actual dimensions of diameters A, B, C, and D, as well as the depth of each portion, that is, its dimensional length along longitudinal axis L, will be determined by the specific application of a given heat exchanger and the desired insertion angle $\alpha$ required far insertion or removal of a heat exchanger tube. Certain factors that will affect the desired insertion angle $\alpha$ include such factors as the diameter of the flow tube, the length of the flow tube, the dimensions of the fin elements of the flow tube, the operating pressure of the heat exchanger, the type of seal used, and beveling of the portions of the aperture, if desired. Diameter A must be large enough to allow tube 4 to be inserted at insertion angle $\alpha$ to axis L without binding the tube within the portion 30 of the header plate and preventing its proper insertion into the header plate, but small enough to provide proper support to retain the seal under system operating pressure. At the limiting tube angle $\alpha$ for a given heat exchanger as shown in FIG. 4, the left side of tube 4, contacts, and its range of motion is limited by, the tube side edge 31 of first portion 30. The right side of tube 4, as seen in FIG. 4, contacts, and it range of motion is limited by, tank side edge of first portion 30 at shoulder 34.

Diameter B must be larger than diameter A in order to provide for seal 50 and shoulder 34 between first and second portions 30, 32. Diameter B and corresponding shoulders fixedly retain seal 50 and is sized to allow seal 50 to be compressed to a designed compression level when tube 4 is in its normal approximately vertical orientation, seen as the left mast tube 4 in FIG. 2. Diameter C must be smaller than diameter B in order to provide far shoulder 38 between second and third portions 32, 36. Diameter C is sized to provide clearance for tube 4 when it is oriented at angle α, as well as providing proper support for seal 50 during tube installation and removal as well as low pressure operation. Low pressure operation refers to a condition in which the pressure sides of upper header plate 10 are reversed. That is, the pressure within upper tank 17 is lower than the tube side, that is, the portion of the heat exchanger between upper and lower header plates 10, 14 which is typically exposed to air. In such a reverse pressure condition, shoulder 38 would provide support against the source of higher pressure. Diameter C may be, in certain preferred embodiments, approximately equal to diameter A.

In certain non-limiting embodiments, diameter D is larger than diameter C. Diameter D is sized to provide clearance for tube 4 when tube 4 is at insertion angle α with respect to longitudinal axis L to prevent binding of tube 4. In other embodiments, diameter D is approximately equal to diameter C or the fourth portion 40 may gradually increase in a beveled manner toward the tank side surface of the heat exchanger plate. The depths of each portion may vary as well based on operating conditions of the heat exchanger. Specifically, for example, the depth of first portion 30 and third portion 36 must be sized to provide a sufficient thickness for shoulder 34 and shoulder 38 which can withstand the pressures incurred by seal 50.

As illustrated in FIGS. 1-5, aperture 18 has the same construction as aperture 16. It is to be appreciated that in other embodiments, aperture 18 may have a constant diameter, or, alternatively, have a single channel containing a groove incorporating a seal to provide a seal between tube 4 and aperture 18.

Figure 5:
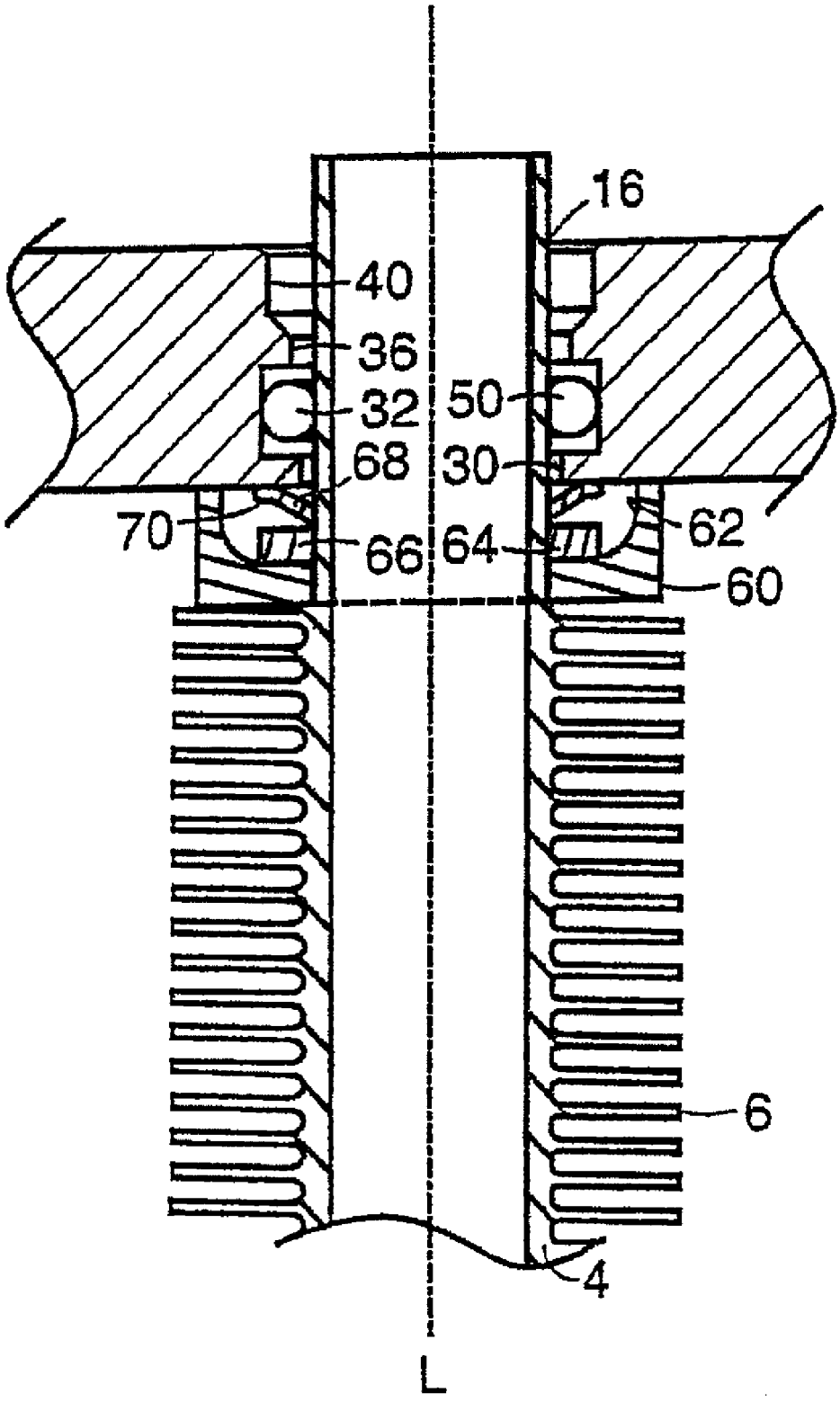
FIG. 5 is a schematic section view of an alternative embodiment of a tube and fin assembly of FIG. 1, shown mounted in a header plate with a dust seal and cupped washer.

In another preferred embodiment, shown in FIG. 5, a cupped washer 60 is provided on tube 4 between upper header plate 10 and an uppermost fin 6. Cupped washer 60 has a substantially C-shaped cross-section forming a concave surface 62 which faces upper header plate 10. A contamination seal 64 is positioned between upper header plate 10 and concave surface 62. Contamination seal 64 is formed of a first portion 66 having a substantially rectangular cross-section and a second portion 68. Second portion 68 extends upwardly and radially outwardly from an upper and radially inner edge of first portion 66, terminating in a lip 70 which extends radially outwardly. In other preferred embodiments, contamination seal 64 may have other constructions, e.g., a substantially rectangular cross section. Contamination seal 64 acts to protect seal 50 from dust and other contaminants which may be encountered in some applications. Cupped washer 60 protects contamination seal 64 and/or apertures 18, 18 from large objects, high-pressure water washers, and other items which may damage contamination seal 64 and/or apertures 16, 18 or otherwise impair the functionality of heat exchanger 2. It is to be appreciated that contamination seal 64 may, in certain preferred embodiments, be used without cupped washer 60. A similar cupped washer 60 and contamination seal 64 may be placed on lower end 12 of tube 4 adjacent lower header plate 14.

It is to be appreciated that in certain embodiments, tubes 4 may have cross-sectional shapes other than circular. For example, tubes 4 may have an oblong cross-section, as opposed to the circular shape in the embodiment illustrated in FIG. 1. In embodiments with tubes 4 having an oblong configuration, the apertures in upper header plate 10 and the apertures in lower header plate 14 will not have diameters as described above, but, rather, will have cross-dimensions, e.g., a length and width. Thus, in such embodiments, the multiple diameters A, B, C and D of the portions of the apertures described above and illustrated in FIG. 3 would instead refer to a length and/or width of the oblong apertures.

Figure 9:
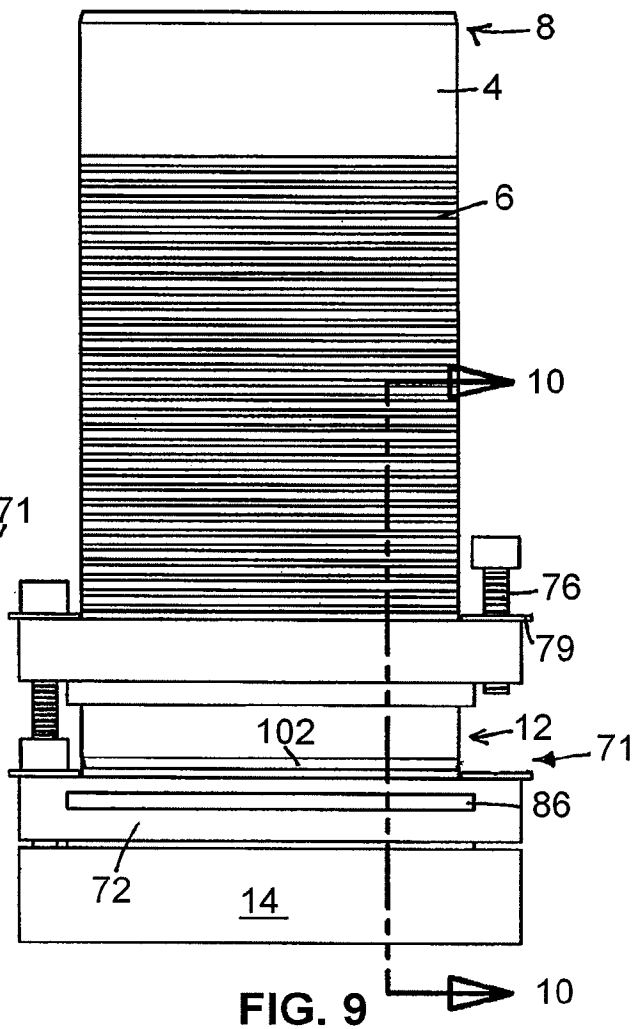
FIG. 9 is a side elevation view of the tube and fin assembly of FIG. 7.
Figure 8:
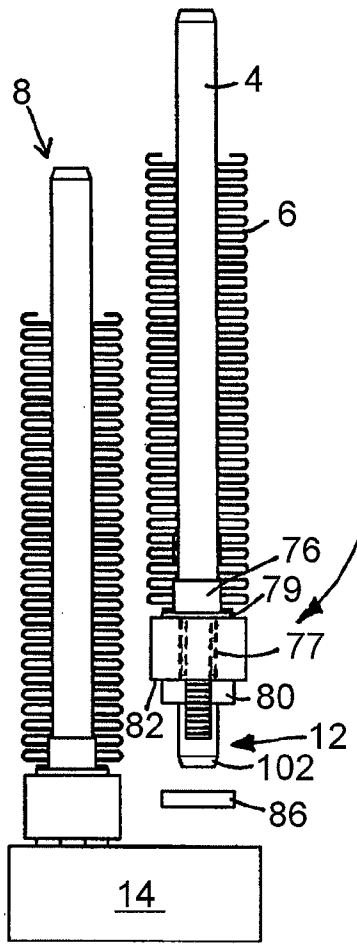
FIG. 8 is a front elevation view of the tube and fin assembly of FIG. 7.
Figure 7:
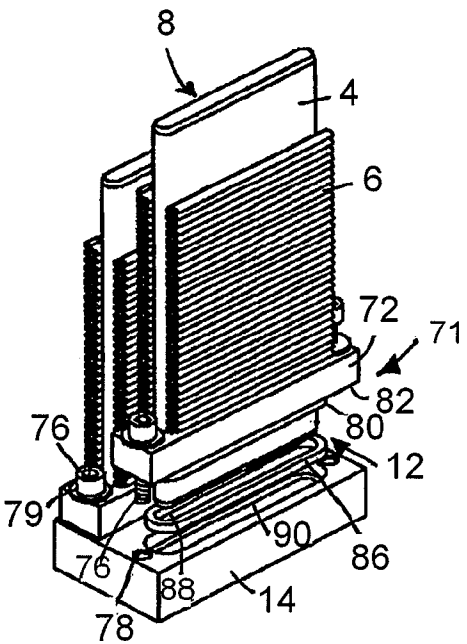
FIG. 7 is a schematic perspective view, of tube and fin assemblies of a heat exchanger, with one tube and fin assembly shown installed in a header plate and a second tube and fin assembly shown prior to installation.

In certain embodiments incorporating oblong tubes, such as those seen in FIG. 7-10, tubes 4 would be tilted along the major axis of their oblong shape for initial insertion into upper header plate 10, that is, to the left and/or right as seen in FIG. 9. Thus, in such an embodiment, the diameters A, B, C, and D of the aperture depicted in FIG. 3 would refer to the length of the aperture, that is, its measurement along the major axis of the oblong aperture. It is to be appreciated that tubes 4 may have a variety of other cross-sectional shapes, with corresponding cross-dimensions.

An alternative embodiment incorporating oblong tubes 4 is illustrated in FIGS. 7-10. In this embodiment, a pair of tubes 4 is seen associated with lower header plate 14. Only two tubes 4 are shown here for illustration purposes. It is to be appreciated that any number of tubes 4 can be incorporated in the heat exchanger. As can be seen in the figures, one tube 4 is shown in its installed condition in lower header plate 14, while the other tube 4 is shown just prior to installation in lower header plate 14. The installation of upper ends 8 of tubes 4 is not illustrated here, as it is described in greater detail elsewhere herein.

A retaining assembly 71 is configured to sealingly retain the lower end 12 of tube 4 within lower header plate 14. Retaining assembly 71 includes a collar 72 seated on lower end 12 of tube 4 between the lowermost fins 6 and lower header plate 14. An aperture 74 extends through collar 72, and receives lower end 12 of tube 4. Collar 72 is secured to lower header plate 14 by bolts 76 that extend through apertures 77 in collar 72 and are threadingly received in threaded apertures 78 formed in lower header plate 14. A washer 79 may be positioned on each bolt 76.

A boss 80 extends downwardly from a lower surface 82 of collar 72, with aperture 74 extending through boss 80. The lower end of aperture 74 has a beveled edge 84 within boss 80. In certain embodiments, beveled edge 84 is beveled at angle of about 45°.

Figure 10:
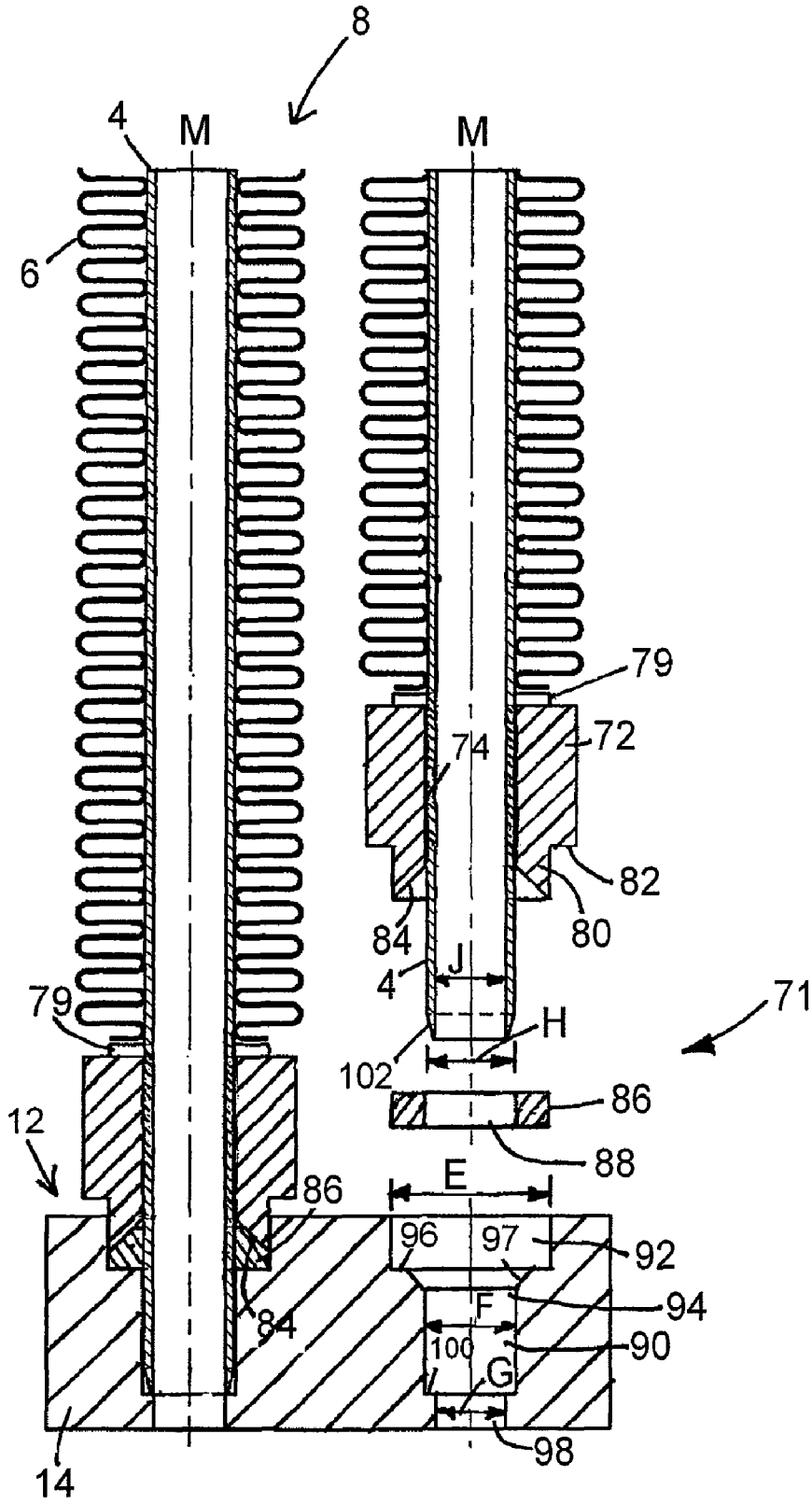
FIG. 10 is a section view of the tube and fin assembly of FIG. 7, taken along line 10-10 of FIG. 9.

A seal 86 is positioned between collar 72 and lower header plate 14. Seal 86 has an aperture 88 extending therethrough, and receives lower end 12 of tube 4. In certain embodiments, seal 86 is a substantially permanently deformable material, which can be compressed within lower header plate 14 when bolts 76 are tightened, providing a good seal about tube 4 within lower header plate 14. In certain applications, seal 86 is formed of a material that is suitable for long term exposure to elevated temperatures, which may degrade elastomeric materials. A flexible graphite type material, for example, may provide a long life span when exposed to elevated temperatures. As illustrated in FIG. 10, seal 86 has a rectangular cross-section. It is to be appreciated that seal 86 can have any desired cross-section including, for example, the cross-sections discussed above with respect to FIG. 6.

An aperture 90 extends through lower header plate 14, and lower end 12 of tube 4 extends into aperture 90. Aperture 90, as seen in FIG. 10, has a longitudinal axis M, which is co-axial with the longitudinal axis of tube 4. Aperture 90, given its oblong configuration, has cross-dimensions rather than a diameter, namely, a width and length. The cross-dimensions of aperture 90 are non-uniform along longitudinal axis M, which is illustrated in FIG. 10 where the width of aperture 90 can be seen. In the illustrated embodiment, aperture 90 has three different portions along its length. On the tube side of aperture 90, a first portion 92 has a first width E. A second portion 94 is adjacent first portion 92 and has a second width F that is smaller than first width E. A first shoulder 96 is formed between first and second portions 92, 94. In certain embodiments, as illustrated in the rightmost aperture 90 of FIG. 10, first shoulder 96 may have a beveled edge 97 where it transitions to second portion 94. A third portion 98 is adjacent second portion 94 and opens into the tank side of lower header plate 14, and has a third width G that is smaller than second width F. A second shoulder 100 is formed between second and third portions 94, 98. Tube 4 has a width H that is slightly smaller than second width F of second portion 94 such that tube 4 can be received within second portion 94. In certain embodiments, the inner diameter J of tube 4 is approximately the same as third width G of third portion 98. In certain embodiments, tube 4 has a tapered outer end surface 102. As noted above, the length of aperture 90, that is, its cross dimension measured in a direction substantially perpendicular to its width, has a similar non-uniform configuration as that described herein with respect to its width. The length of aperture 90 would be into the page as seen in FIG. 10.

When the lower end 12 of tube 4 is assembled with lower header plate 14 and collar 72 is secured to lower header plate 14, seal 86 is seated on first shoulder 96, and the end of tube 4 is seated on shoulder 100. Bolts 76 are tightened such that seal 86 is deformed into the space defined by shoulder 96, beveled surface 84 of collar 72, the sidewall of first portion 92 and tube 4, as seen in the leftmost tube assembly in FIG. 10. In particular, beveled surface 84 forces second seal down onto first shoulder 96 and inwardly against the exterior of tube 4, thereby providing a seal between tube 4 and lower header plate 14.

In certain embodiments, when collar 72 is secured to lower header plate 14, lower surface 82 is spaced from lower header plate 14, thereby allowing further tightening of bolts 76 without collar 72 bottoming out on lower header plate 14.

It is to be appreciated that a retaining assembly 71 as depicted in FIGS. 7-10 with respect to lower header plate 14 may also be incorporated in upper header plate 10.

Figure 11:
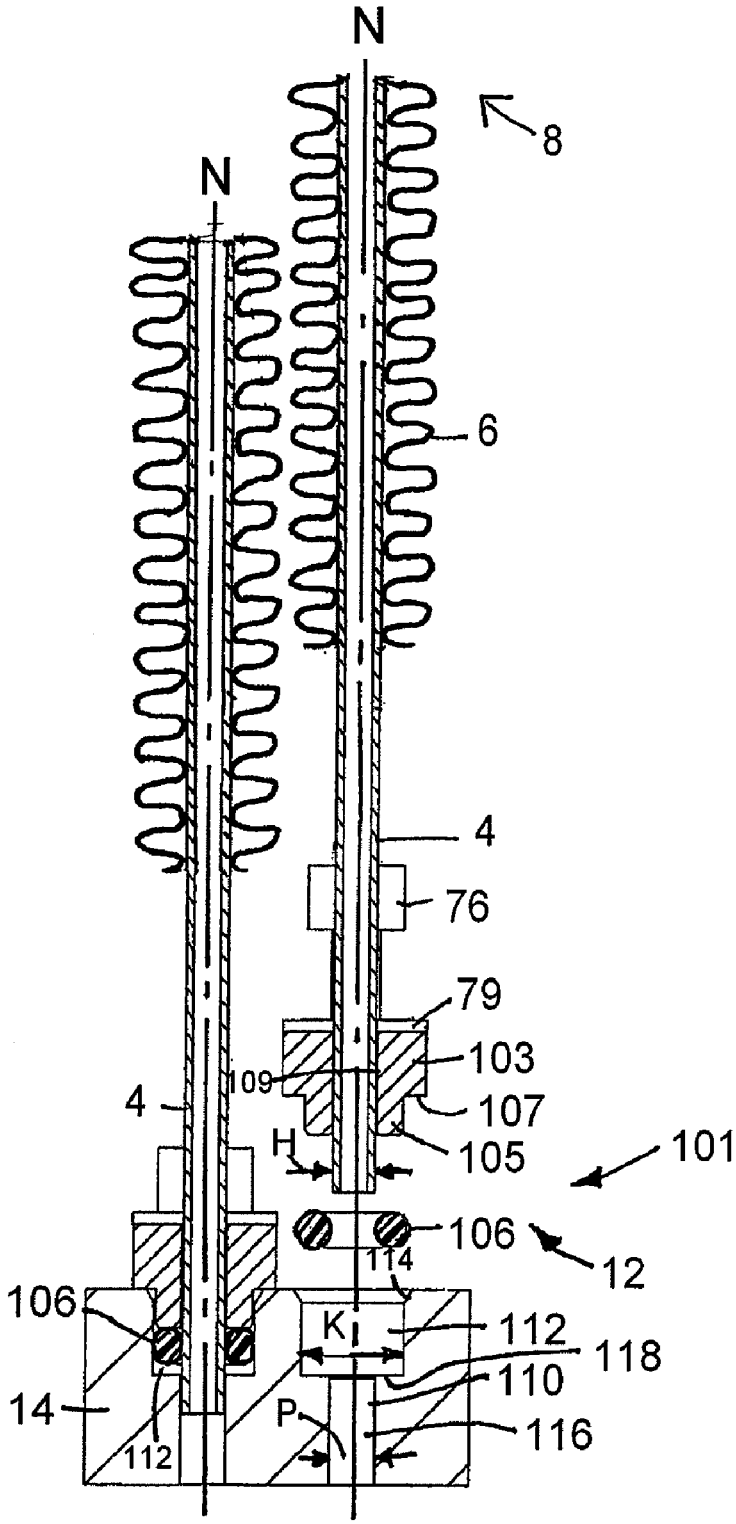
FIG. 11 is a section view of an alternative embodiment of a tube and fin assembly of FIG. 7.

Another embodiment of a retaining assembly 101 is illustrated in FIG. 11, in which a collar 103 has a boss 105 extending downwardly from its lower surface 107. An aperture 109 extends through collar 103 and boss 105, and receives the lower end 12 of tube 4. An elastomeric seal 106 is seated on lower end 12 of tube 4 and is positioned in lower header plate 14 when tube 4 is inserted into lower header plate 14. As illustrated in FIG. 11, seal 106 has a circular cross-section. It is to be appreciated that seal 106 can have any desired cross-section including, for example, the cross-sections discussed above with respect to FIG. 6. Such an embodiment is particularly advantageous in applications in which the fluid temperatures do not adversely affect the properties and/or life span of an elastomeric seal. Lower header plate 14 has an aperture 110 with non-uniform cross-dimensions along its longitudinal axis N.

In the illustrated embodiment, aperture 110 has two different portions along its longitudinal axis N. On a tube side of aperture 110, a first portion 112 has a first width K. In certain embodiments, first portion 112 has a beveled edge 114, which allows seal 106, and boss 105 of collar 103 to be more easily inserted into aperture 110 of lower header plate 14.

A second portion 116 is adjacent first portion 112 and opens into the tank side of lower header plate 14, and has a second width P that is smaller than first width K. A shoulder 118 is formed between first and second portions 112, 116. The width H of tube 4 is slightly smaller than second width P of second portion 116 such that tube 4 can be received within second portion 116.

When tube 4 is inserted into lower header plate 14 and seal 106 is forced into first portion 112 by collar 103, seal 106 is compressed between tube 4 and the wall of first portion 112, providing a seal about tube 4. Under certain conditions, the pressure from the tank side of lower header plate 14 may also compress seal 106 against the lower surface of boss 105. Shoulder 118, being positioned below seal 106, may also serve to retain seal 106 under certain conditions.

It is to be appreciated that a retaining assembly 101 such as that depicted in FIG. 11 with respect to lower header plate 14 may also be incorporated in upper header plate 10. In such an embodiment, it is to be appreciated that the length of each of first portion 112 and second portion 116 (which would be on the tube and tank side of upper plate 10, respectively, and would extend in a direction substantially perpendicular to widths P and K, respectively) will allow for insertion of tube 4 at an angle, as described above in greater detail with respect to FIGS. 2-4.

It is to be appreciated that the embodiments described in connection with FIGS. 7-10 and FIG. 11 for lower header plate 14 may be combined with those described above in connection with FIGS. 1-5 for upper header plate 10 in any desired combination. Thus, for example, either of the retaining assemblies 71, 101 with a corresponding collar and seal as described here with respect to lower header plate 14 may also be used with upper header plate 10.

Retaining assemblies, including the embodiments described above in connection with FIGS. 7-11, provide numerous advantages. For example, such retaining assemblies are particularly advantageous in that they provide for reduced clearances, which are required for high pressure operation, between the tube and the collar to retain the seal. Additionally, improved manufacturability of the header plate is realized, especially with narrow tube configurations, which tend to provide improved efficiencies. Further, such retaining assemblies provide for ease of assembly by improving the process of insertion of the seal into the header plate. These retaining assemblies also allow the tubes to be inserted at a greater angle while minimizing damage to the seals and/or tubes that may be incurred during installation. Such retaining assemblies advantageously allow access and installation of tube and fin assemblies and sealing members from the tube side of the heat exchanger, which is particularly advantageous in applications where access to the tank side is restricted, unavailable, or undesirable.

Figure 12:
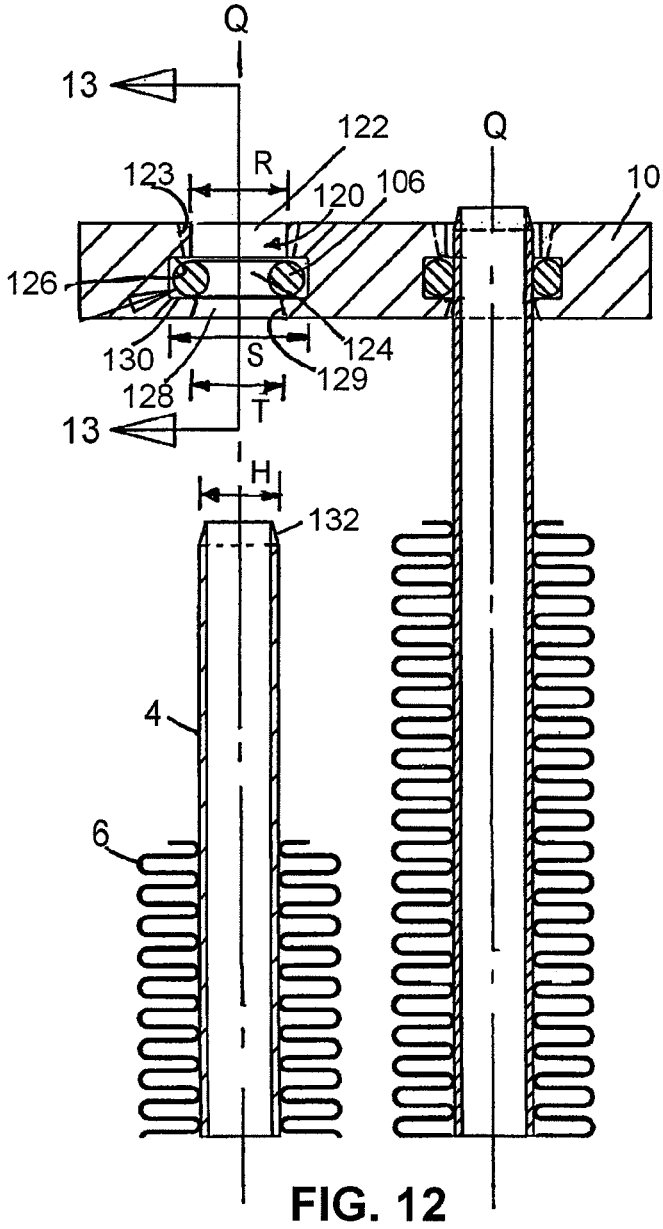
FIG. 12 is a section view of an alternative embodiment of a tube and fin assembly shown with an upper header plate.
Figure 14:
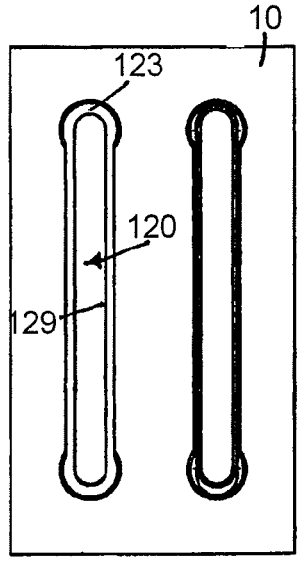
FIG. 14 is a top plan view of the tube and fin assembly of FIG. 12.
Figure 13:
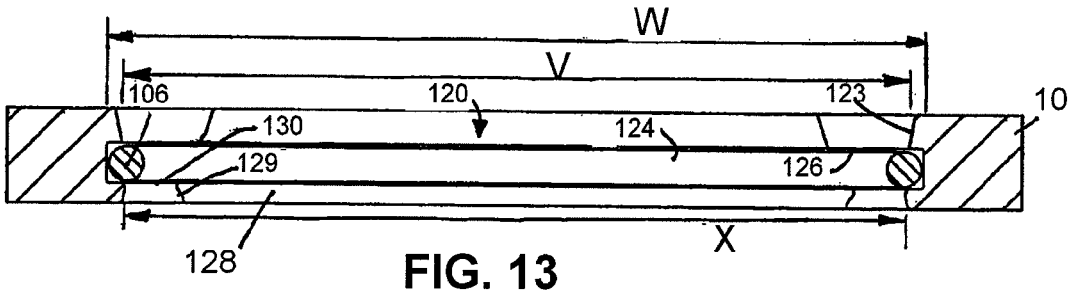
FIG. 13 is a section view of the upper header plate of FIG. 12, taken along line 13-13 of FIG. 12.

Another embodiment of an oblong tube construction is shown in FIGS. 12-14 with respect to upper header plate 10. An aperture 120 extends through upper header plate 10, and upper end 8 of tube 4 extends into aperture 90. Aperture 120, as seen in FIG. 12, has a longitudinal axis Q, which is co-extensive with the longitudinal axis of tube 4. Aperture 120, given its oblong configuration, has cross-dimensions rather than a diameter, namely, a width and length. The cross-dimensions of aperture 120 are non-uniform along longitudinal axis Q, which is illustrated in FIGS. 12-13 where the width and length, respectively, of aperture 120 can be seen. In the illustrated embodiment, aperture 120 has three different portions along its longitudinal axis Q. On the tank side of aperture 120, as seen in FIG. 12, a first portion 122 has a first width R. In certain embodiments, first portion 122 is chamfered at opposed ends of aperture 120, as seen in FIGS. 13-14, to provide a beveled edge 123, providing an angled wall suitable for tilting tube 4 as it is removed and replaced, as discussed in greater detail above.

A second portion 124 of aperture 120 is adjacent first portion 122 and has a second width S that is larger than first width R. A first shoulder 126 is formed between first and second portions 122, 124 at the upper side of second portion 124. A third portion 128 is adjacent second portion 124 and opens into the tube side of upper header plate 10, and has a third width T that is smaller than second width S. A second shoulder 130 is formed between second and third portions 124, 128 at the lower side of second portion 124. Third portion 128 may have a beveled surface 129, which allows for the tilting of tube 4 as it is removed and replaced, as discussed in greater detail above. As seen in FIG. 13, first portion 122 has a first length V, second portion 124 has a second length W, and third portion 128 has a third length X. As noted above, third portion may have beveled edge 123, allowing tube 4 to be tilted along the major axis of its oblong shape, that is, to the left or right with respect to upper header plate 10 as seen in FIG. 13.

The width H of tube 4 is slightly smaller than third width T of third portion 128 such that tube 4 can be received within upper header plate 10. In certain embodiments, tube 4 has a tapered outer end surface 132.

Seal 106 is captured within second portion 124, and is compressed between the exterior of tube 4 and the wall of second portion 124. It is to be appreciated that seal 106 may also engage one or both of first shoulder 126 and second shoulder 130 of second portion 124.

In light of the foregoing disclosure of the invention and description of the preferred embodiments, those skilled in this area of technology will readily understand that various modifications and adaptations can be made without departing from the true scope and spirit of the invention.

What is claimed is:

1. A header plate assembly for a heat exchanger comprising:

a header plate having a tube side and a tank side; and a plurality of apertures extending through the plate;

each aperture having a first portion on the tube side of the plate, the first portion having a first cross-dimension, and a second portion adjacent the first portion and having a second cross-dimension that is smaller than the first cross-dimension, a first shoulder being formed between the first and second portions;

a plurality of collars, each collar having an aperture extending therethrough;

at least one collar including a boss extending outwardly therefrom and having a beveled edge, the aperture of the collar extending through the boss, at least a portion of the boss having the beveled edge being received in the first portion of one of the apertures in the plate;

a seal positioned in each of the first portions of the apertures and positioned between one of the beveled edges of the boss and one of the first shoulders; and a fasteners extending through the collars to the plate.

2. The header plate assembly of claim 1, wherein each aperture includes a third portion on the tank side of the plate and adjacent the second portion, the third portion having a third cross-dimension that is smaller than the second cross-dimension.

3. The header plate assembly of claim 1, wherein at least one of the apertures in the plate is oblong.

4. The header plate assembly of claim 1, wherein the fasteners is a bolt.

5. The header plate assembly of claim 1, wherein at least one seal is formed of a substantially permanently deformable material.

6. The header plate assembly of claim 1, wherein at least one seal is formed of an elastomeric material.

7. The header plate assembly of claim 1, wherein a bevel is formed between the first portion and the second portion of at least one aperture in the plate.

8. The header plate assembly of claim 1, wherein a bevel is formed on the first portion of at least one aperture in the plate on the tube side of the plate.

9. A heat exchanger comprising:

a first header plate having a tube side and a tank side; and a plurality of first apertures extending through the first header plate, each first aperture having a first portion on the tube side of the first header plate, the first portion having a first cross-dimension, and a second portion adjacent the first portion and having a second cross-dimension that is smaller than the first cross-dimension, and a first shoulder formed between the first and second portions;

a plurality of flow tubes having a first end and a second end and a plurality of fins on an exterior surface thereof, a first end of one of the flow tubes being received in each of the first apertures;

a plurality of collars, each collar having an aperture extending therethrough;

at least one collar including a boss extending outwardly therefrom and having a beveled edge, the aperture of the collar extending through the boss, at least a portion of the boss having the beveled edge being received in the first portion of one of the apertures in the plate;

a seal positioned in each of the first portions of the first apertures in the first header plate and positioned between one of the beveled edges of the boss and one of the first shoulders; and a fasteners extending through the collars to the plate.

10. The heat exchanger of claim 9, further comprising a second header plate having a tank side and a tube side and having a plurality of second apertures, each second aperture having a longitudinal axis L and a wall of non-uniform diameter at least three locations, each of the three locations having a diameter different than the diameter at each of the other two locations, and including a seal fixedly engaged within the aperture between the tank and tube sides by shoulders formed by differing diameters of the wall; and wherein the diameter at each location is sufficiently large enough to accommodate insertion of one of the flow tubes into the second aperture from the tube side at an insertion angle $\alpha$ to the longitudinal axis L and removal of the flow tube from the tube side without disassembling a frame of the heat exchanger, where $\alpha$ is greater than zero degrees, and wherein the seal is configured to engage the flow tube after insertion of the flow tube into the aperture.

11. The heat exchanger of claim 9, wherein at least one first aperture in the first header plate includes a third portion on the tank side of the first header plate and adjacent the second portion, each third portion having a third cross-dimension that is smaller than the second cross-dimension.

12. The heat exchanger of claim 11, wherein at least one first aperture in the first header plate includes a second shoulder between the second and third portions of the first aperture in the first header plate, the first end of one of the flow tubes engaging one of the second shoulders.

13. The heat exchanger of claim 9, wherein the boss, the seal, and the first portion of the first aperture are dimensioned such that only a portion of the boss is received in the first portion of the aperture when the collar is secured to the first header plate.

14. The header plate assembly of claim 9, wherein each aperture includes a third portion on the tank side of the first header plate and adjacent the second portion, the third portion having a third cross-dimension that is smaller than the second cross-dimension.

15. The header plate assembly of claim 9, wherein at least one of the apertures in the first header plate is oblong.

16. The header plate assembly of claim 9, wherein the fasteners is a bolt.

17. The header plate assembly of claim 9, wherein at least one seal is formed of a substantially permanently deformable material.

18. The header plate assembly of claim 9, wherein at least one seal is formed of an elastomeric material.

19. The header plate assembly of claim 9, wherein a bevel is formed between the first portion and the second portion of at least one aperture in the first header plate.

20. The header plate assembly of claim 9, wherein a bevel is formed on the first portion of at least one aperture in the plate on the tube side of the plate.

* * * * *